US006710672B2

(12) United States Patent
Hasegawa

(10) Patent No.: US 6,710,672 B2
(45) Date of Patent: Mar. 23, 2004

(54) NONRECIPROCAL CIRCUIT DEVICE, COMMUNICATION APPARATUS, AND METHOD FOR MANUFACTURING NONRECIPROCAL CIRCUIT DEVICE

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 35 days.

(21) Appl. No.: 09/726,713

(22) Filed: Nov. 30, 2000

(65) Prior Publication Data

US 2002/0070819 A1 Jun. 13, 2002

(30) Foreign Application Priority Data

Nov. 30, 1999 (JP) ..... 11-340425

(51) Int. Cl.[7] ..... H01P 1/38
(52) U.S. Cl. ..... 333/1.1; 333/24.2
(58) Field of Search ..... 333/1.1, 24.2

(56) References Cited

U.S. PATENT DOCUMENTS

| | | | | |
|---|---|---|---|---|
| 5,068,629 A | | 11/1991 | Nishikawa et al. | 333/1.1 |
| 5,197,170 A | * | 3/1993 | Senda et al. | 29/602.1 X |
| 6,087,905 A | * | 7/2000 | Makino et al. | 333/1.1 |

FOREIGN PATENT DOCUMENTS

| | | | | |
|---|---|---|---|---|
| EP | 0 915 527 | | 5/1999 | H01P/1/387 |
| JP | 1-031494 A | | 2/1989 | |
| JP | 64-031494 | | 2/1989 | H05K/1/11 |
| JP | 6-125173 A | | 5/1994 | H05K/3/41 |
| JP | 06204712 A | * | 7/1994 | H01P/1/383 |
| JP | 6-252610 A | | 9/1994 | H01P/1/36 |
| JP | 6-268342 A | | 9/1994 | H05K/1/02 |
| JP | 07058525 A | * | 3/1995 | H01P/1/383 |
| JP | 08-56013 | | 3/1996 | H01P/1/36 |
| JP | 08065013 A | * | 3/1996 | H01P/1/36 |
| JP | 9-307315 | | 11/1997 | H01P/1/383 |
| JP | 11-097909 A | | 4/1999 | |
| JP | 11298206 A | * | 10/1999 | H01P/1/383 |

* cited by examiner

*Primary Examiner*—Robert Pascal
*Assistant Examiner*—Stephen E. Jones
(74) *Attorney, Agent, or Firm*—Keating & Bennett, LLP

(57) ABSTRACT

A nonreciprocal circuit device and a communication apparatus using the same are provided. According to the nonreciprocal circuit device, without increasing the size of a housing for the nonreciprocal circuit device, a high-frequency component to be provided in the housing can be easily and securely mounted. Central conductors are arranged so as to mutually intersect; each of matching capacitors is connected to a portion between each of ports of the central conductors and each of ground terminals; and a nonreciprocal circuit is thereby configured. A resistor is premounted on a substrate. In this state, the substrate is installed in a resin housing.

13 Claims, 18 Drawing Sheets

A-A CROSS-SECTIONAL VIEW

B-B CROSS-SECTIONAL VIEW

B-B CROSS-SECTIONAL VIEW

B-B CROSS-SECTIONAL VIEW

B-B CROSS-SECTIONAL VIEW

A-A CROSS-SECTIONAL VIEW

A-A CROSS-SECTIONAL VIEW

NONRECIPROCAL CIRCUIT DEVICE, COMMUNICATION APPARATUS, AND METHOD FOR MANUFACTURING NONRECIPROCAL CIRCUIT DEVICE

BACKGROUND OF THE INVENTION

1. Field of the Invention

The present invention relates to a nonreciprocal circuit device, such as an isolator and a circulator, for use in a high-frequency band such as a microwave band; a communication apparatus using the nonreciprocal circuit device; and a manufacturing method for the nonreciprocal circuit device.

2. Description of the Related Art

Conventionally, apparatuses such as communication apparatuses use nonreciprocal circuit devices, such as lumped-parameter-type isolators and circulators, making use of their characteristics in which the amount of attenuation is extremely small in the direction along which a signal is transmitted, and is extremely large in the reverse direction.

An exploded perspective view of a conventional isolator is shown in FIG. 21A, and an interior construction thereof is shown in FIG. 22B. However, an A—A cross-sectional view in FIG. 22B shows only a cut face along the A—A line.

As shown in FIGS. 21A to 22B, the isolator is constructed such that a magnetic assembly 5 having central conductors 51, 52, and 53 and a ferrite member 54, a permanent magnet 3, and a resin housing 7 are individually arranged in a closed magnetic circuit formed primarily by an upper yoke 2 and a lower yoke 8. Ports P1 and P2 of the central conductors 51 and 52 are connected to input/output terminals 71 and 72 formed in the resin housing 7 and to matching capacitors C1 and C2. A port P3 of the central conductor 53 is connected to a matching capacitor C3 and a termination resistor R. One end of each the capacitors C1, C2, and C3 and the termination resistor R is connected to a ground terminal 73.

As shown in FIGS. 22A and 22B, one electrode of the resistor R is connected to the ground terminal 73, the other electrode is connected to an electrode provided in the resin housing 7. Also, the port P3 of the central conductor 53 is connected to the electrode and an upper electrode of the matching capacitor C3 so as to stride across the two electrodes.

FIGS. 23A and 23B show an upper view and a cross-sectional view, respectively, of an isolator having a construction differing from that shown in FIGS. 22A and 22B. Specifically, the construction in FIGS. 23A and 23B is in a state that the upper yoke 2 is removed from that shown in FIGS. 22A and 22B. In this example, one electrode of the termination resistor R is connected to the ground terminals 73, the other electrode is connected to the upper electrode of the matching capacitor C3, and the termination resistor R is thereby arranged in a position higher than the matching capacitor C3.

In the conventional isolator having the construction shown in FIGS. 22A and 22B, since the termination resistor R and the matching capacitor C3 are arranged at the same height, the dimensions of the matching capacitor C3 are restricted by the termination resistor R. Specifically, the inside-diametric dimension of the resin housing 7 cannot be reduced smaller than the sum of the addition of longitudinal dimensions of the termination resistor R and the matching capacitor C3. Therefore, the isolator is not suitable to miniaturization.

In the conventional isolator having the construction shown in FIGS. 23A and 23B, since the termination resistor R is arranged higher than the matching capacitor C3, the dimensions of the matching capacitor C3 are not restricted by the termination resistor R. Therefore, the isolator can be miniaturized smaller than that having the construction shown in FIGS. 22A and 22B. However, in the manufacture of the isolator shown in FIGS. 23A and 23B, a solder paste is applied on a bottom face (grounded face). Therefore, the matching capacitor C3 tends to skew when a binder component melts and volatilizes, and solder powders melt. Thereafter, when a solder paste on the bottom face of the matching capacitor C3 becomes in a uniformly melted state, the skewed matching capacitor C3 returns to the original state. However, at an initial stage when the matching capacitor C3 is skewed because of heating of the solder paste, the termination resistor R is also caused to skew. In addition, a lower face of the termination resistor R individually contacts the immovable ground terminal 73 and the matching capacitor C3 that tends to skew. Therefore, when the solder melts, a so-called tombstone phenomenon is apt to occur. Specifically, chip-type components are apt to rise according to a surface tension of the melted solder, and insufficient contact is apt to be caused.

SUMMARY OF THE INVENTION

Accordingly, an object of the present invention is to provide a nonreciprocal circuit device that solves the above-described problems, that can be easily miniaturized, and that improves reliability.

Another object of the invention is to provide a communication apparatus using the nonreciprocal circuit device.

Still another object of the invention is to provide a manufacturing method for the nonreciprocal circuit device.

According to one aspect of the present invention, a nonreciprocal circuit device of the present invention is configured such that a magnetic body which receives a direct-current magnetic field and a plurality of central conductors intersecting with each other provided on the magnetic body are stored in a housing. A substrate having a high-frequency component is stored in the housing, and at least one port of the plurality of central conductors is electrically connected to one of an electrode of the high-frequency component and an electrode on the substrate which is electrically connected to the electrode of the high-frequency component.

In the above construction, the high-frequency component, such as a resistor, is premounted on the substrate, thereby solving the above-described problems that are caused when the substrate is overlaid on the matching capacitors and the like. According to the above, a highly reliable nonreciprocal circuit device can be obtained in which the high-frequency component, such as a resistor, an inductor, or a capacitor, does not cause insufficient connection due to, for example, a tombstone phenomenon, in a housing.

In the nonreciprocal circuit device, a cutout portion may be formed at one of a side and a corner of the substrate. According to the cutout portion, when the substrate is stored in the housing for the nonreciprocal circuit device, an arrangement can be made such that a machine for performing the storing processing automatically detects the obverse and reverse faces and the direction of the substrate.

In addition, in the nonreciprocal circuit device, electrodes on obverse and reverse faces may be electrically connected together via an end face of the cutout portion. According to this, the cutout portion is concurrently used as the through-hole.

Furthermore, the high-frequency component includes electrodes on plate-like obverse and reverse faces thereof, the arrangement may be such that the electrode on the reverse face of the high-frequency component is electrically connected to the electrode on the substrate, and the electrode on the obverse face of the high-frequency component and the electrode on the substrate are connected together via a step-shaped metal plate. According to this arrangement, the high-frequency component having the electrodes on plate-like obverse and reverse faces of its own can be mounted on the substrate, and further miniaturization can be implemented overall by suing the small high-frequency component.

For the high-frequency component, one of a resistor, an inductor, and a capacitor may be used. For example, on the substrate, an inductor and a capacitor for forming a filter circuit may be mounted, or an inductor as part of a filter circuit may be mounted. Thus, a nonreciprocal circuit device having a resistor as a termination resistor and a nonreciprocal circuit device having a filter circuit formed of an inductor and a capacitor can be easily configured.

According to another aspect of the present invention, a communication apparatus is configured using the above-described nonreciprocal circuit device in a transmission/reception circuit section of an antenna-sharing circuit. This allows the communication apparatus to be miniaturized.

According to still another aspect of the present invention, a manufacturing method for the nonreciprocal circuit device comprises steps of mounting high-frequency components in units of a plurality of sections of a primary substrate; cutting out substrates from the primary substrate in the units of the plurality of sections; and storing, in the housing, a respective one of the substrates on which the high-frequency components are mounted, the magnetic body which receives the direct-current magnetic field, and the plurality of central conductors intersecting with each other provided on the magnetic body. According to this manufacturing method, since mounting of the high-frequency components on the primary substrate and forming of the plurality of substrates can be performed on the block, the productivity can be improved.

According to still another aspect of the the present invention, a manufacturing method for the nonreciprocal circuit device comprises steps of cutting out individual substrates from a primary substrate in teh units of a plurality of sections, mounting high-frequency components on the individual substrate, and storing, in the housing, each of the substrates, the magnetic body which receives the direct-current magnetic field, and the plurality of central conductors intersecting with each other provided on the magnetic body. According to the above, the invention can be applied to a manufacturing system for individually mounting a high-frequency component on the substrate.

According to still another aspect of the present invention, a manufacturing method for the nonreciprocal circuit device comprises steps of providing openings at a border of a plurality of sections of a primary substrate, forming cutout portions by cutting substrates from the primary substrate in the units of the plurality of sections. According to the above, the cutout portions are formed on the block, the productivity is thereby improved.

Furthermore, according to still another aspect of the present invention, a manufacturing method for the nonreciprocal circuit device comprises steps of detecting obverse and reverse faces and the direction of said substrate having cutout portions according to the position of said cutout portions, storing the substrate in the housing such that a predetermined face of the substrate is arranged in a predetermined direction. With this arrangement, the substrate can be securely stored in the housing for the nonreciprocal circuit device, without causing misplacement in the obverse and reverse sides and the direction of the substrate.

DESCRIPTION OF THE PREFERRED EMBODIMENTS

[Description of the Embodiments]

Referring to FIGS. 1 to 4, a description will be given of a configuration of an isolator according to a first embodiment.

Figure 1:
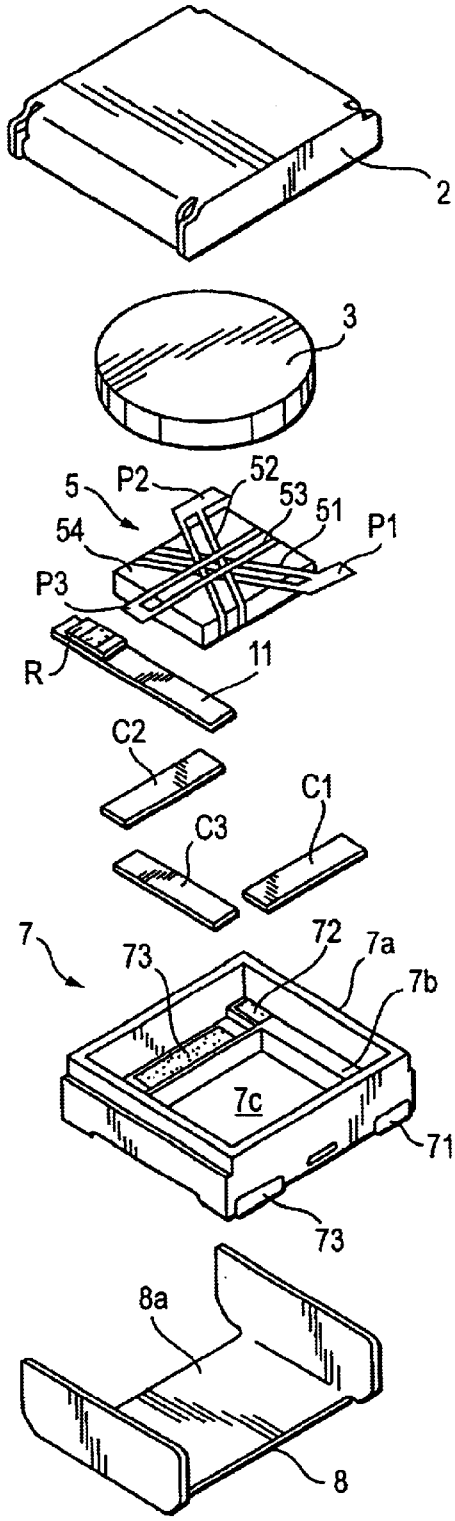
FIG. 1 is an exploded perspective view of an isolator of a first embodiment.
Figure 2A:
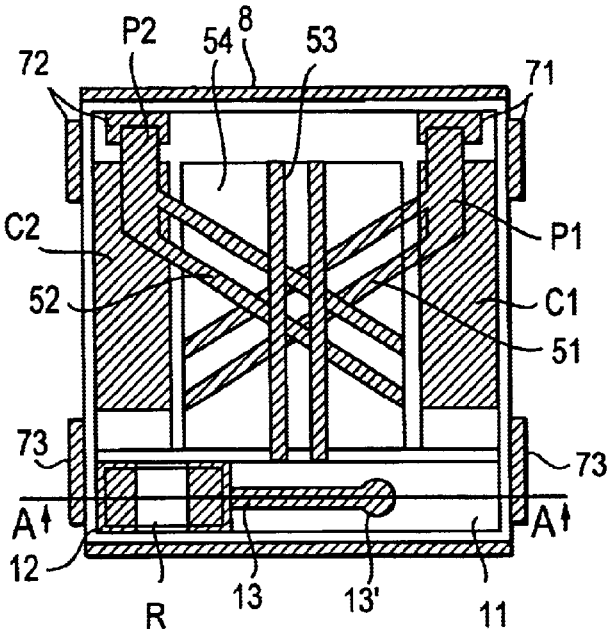
FIGS. 2A and 2B are an upper view and a cross-sectional view, respectively, of the isolator in a state where an upper yoke is removed.
Figure 2B:
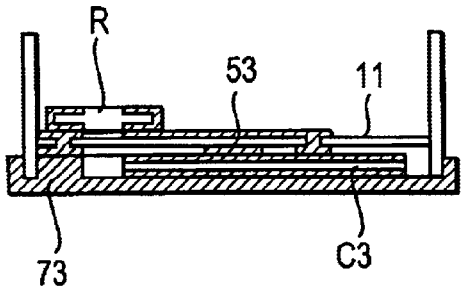

FIG. 1 is an exploded perspective view of the isolator; and FIGS. 2A and 2B are, respectively, an upper view and a cross-sectional view thereof in a state where an upper yoke is removed.

As shown in FIGS. 1 to 2B, in the isolator, a disc shaped permanent magnet 3 is arranged on an inner face of a box-like upper yoke 2 formed of a magnetic metal; a closed magnetic circuit is formed of the upper yoke 2 and a substantially U-shaped lower yoke 8 formed of the same magnetic metal as above; and a resin housing 7 is arranged on a bottom face 8*a* of the lower yoke 8. In addition, a magnetic assembly 5, a substrate 11 with a termination resistor R being mounted, and matching capacitors C1, C2, and C3 are arranged in the resin housing 7.

The magnetic assembly 5 has the following construction. A common ground section which three central conductors 51, 52 and 53 shares is arranged so as to abut a lower face of a parallelepiped ferrite member 54. The common ground section has the same shape as the bottom face of the ferrite member 54. On an upper face of the ferrite member 54, the three central conductors 51, 52 and 53 that extend from the ground section are bent at 120 degrees to each other and are arranged via an insulation sheet (not shown). Ports P1, P2, and P3 on ends of the central conductors 51, 52 and 53 are formed so as to protrude outward. A direct-current magnetic field is applied to the magnetic assembly 5 by the permanent magnet 3 to permit a magnetic flux to pass to the ferrite member 54 in the thickness direction thereof.

The resin housing 7 is formed of an electrical insulating member such that a bottom wall 7*b* is integrated with a rectangular sidewall 7*a*, and input/output terminals 71 and 72 and the ground terminal 73 are partly embedded in the resin. An insertion hole 7*c* is formed in a central portion of the bottom wall 7*b*, and the magnetic assembly 5 is inserted in the insertion hole 7*c*. The ground section of the central conductors 51, 52, and 53 on the lower face of the magnetic assembly 5 are connected to the bottom face 8*a* of the lower yoke 8 by soldering. The input/output terminals 71 and 72 are arranged at two corner portions of one side face of the resin housing 7, and the ground terminals 73 are arranged at two corner portions of another side of the resin housing 7. One end of each of the input/output terminals 71 and 72 and the ground terminals 73 arranged so as to be exposed on an upper face of the bottom wall 7*b*, and the other end of each of them are arranged to be exposed on a lower face of the bottom wall 7*b* and on an outer face of the sidewall 7*a*.

The substrate 11 with the chip-type termination resistor R being mounted, and the chip-type matching capacitors C1, C2, and C3 are arranged around the insertion hole 7*c*. A lower-face electrode of each of the matching capacitors C1, C2, and C3 is connected to the ground terminals 73. Upper-face electrodes of the matching capacitors C1, C2, and C3 are connected to the ports P1, P2, and P3 of the central conductors 51, 52, and 53, respectively.

Conductor patterns 12 and 13 to which two electrodes of the termination resistor R are electrically connected are formed on the substrate 11. In addition, a through-hole 13' that electrically connects to a conductor pattern on the reverse face of the substrate 11 is formed at the end of the conductor pattern 13. Also, a through-hole that electrically connects to a conductor pattern on the reverse face of the substrate 11 is formed in the conductor pattern 12. The individual electrodes of the termination resistor R mounted on the surface of the substrate 11 are electrically connected to the ground terminal 73 and the upper-face electrode of the matching capacitor C3 via the conductor patterns and the through-holes. Interelectrode electrical connection in the described individual portions is performed by soldering.

Figure 3:
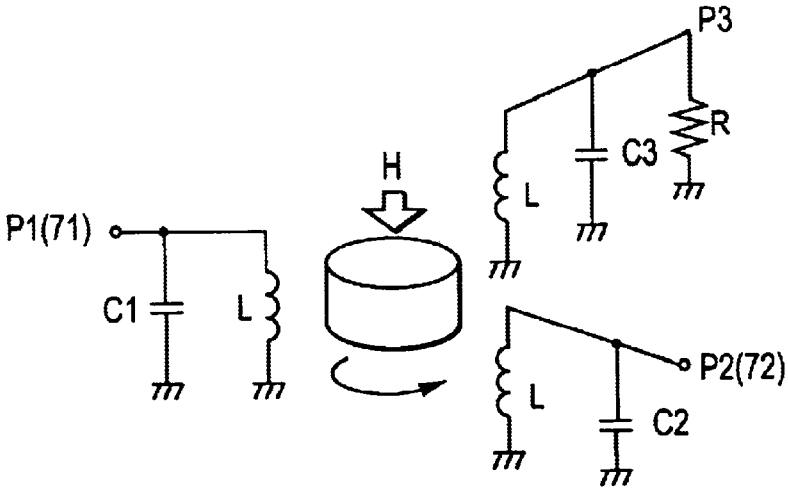
FIG. 3 is an equivalent circuit diagram of the isolator.

FIG. 3 is an equivalent circuit diagram of the above-described isolator.

In the figure, the ferrite member is shown in a disc shaped shape, a direct-current electric field is represented by H, and the above-described central conductors 51, 52 and 53 are represented by equivalent inductors L. According to this configuration, a signal supplied to the input/output terminal 71 is output from the input/output terminal 72 with a low insertion loss. Also, a signal supplied to the input/output terminal 72 is resisted and terminated by the termination resistor R connected to between a ground and the port P3 of the central conductor 53, and the signal almost does not return to the side of the input/output terminal 71.

Figure 4A:
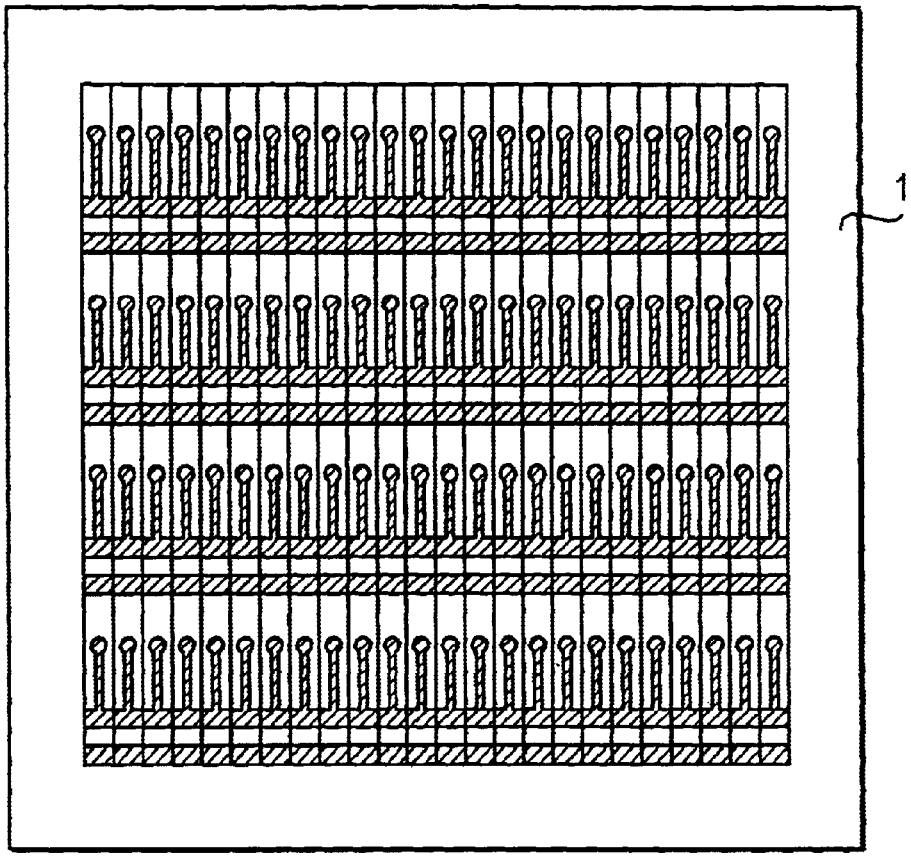
FIGS. 4A and 4B show a state in a manufacturing step for substrates, each of which is used for the isolator.
Figure 4B:
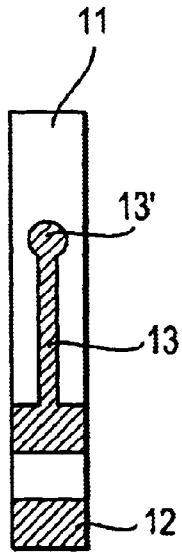

FIGS. 4A and 4B show manufacturing processing for the substrate 11. FIG. 4A shows a state of a primary substrate 1, in which a conductor pattern is formed in each of many sections. FIG. 4B is a view corresponding to one of the sections, which shows a configuration of the substrate 11 cut out from the primary substrate 1. The conductor patterns 12 and 13 are formed on the surface of the substrate 11; and as shown in FIGS. 2A and 2B, the termination resistor R is soldered between the conductor patterns 12 and 13. The through-hole 13' for electrically connecting to the conductor pattern on the reverse face is formed at one end of the conductor pattern 13, and also, the through-hole for electrically connecting to the conductor pattern on the reverse face is formed in the conductor pattern 12.

By using the substrate 11, since surface-mounting of the chip-type components is performed on the continuous integral plane, the tombstone phenomenon does not occur on the substrate 11 when the termination resistor R is mounted. Also, when the substrate 11 having the termination resistor R being mounted is stored in the resin housing 7 of the isolator, and the conductor patterns on the reverse face of the substrate 11 are mounted by soldering to the ground terminals 73 and the upper-face surfer electrode of the matching capacitor C3, the component (substrate 11) having a bottom area larger than the termination resistor R, and, in this example, the substrate having an area larger than the lower matching capacitor C3 is used. Therefore, the substrate 11 is not inclined when the solder is melted, and the mounting can be easily implemented. In addition, since the length of the substrate 11 is arranged to be substantially the same as the inner width of the resin housing 7, positioning thereof to the resin housing 7 is easily implemented.

Figure 5A:
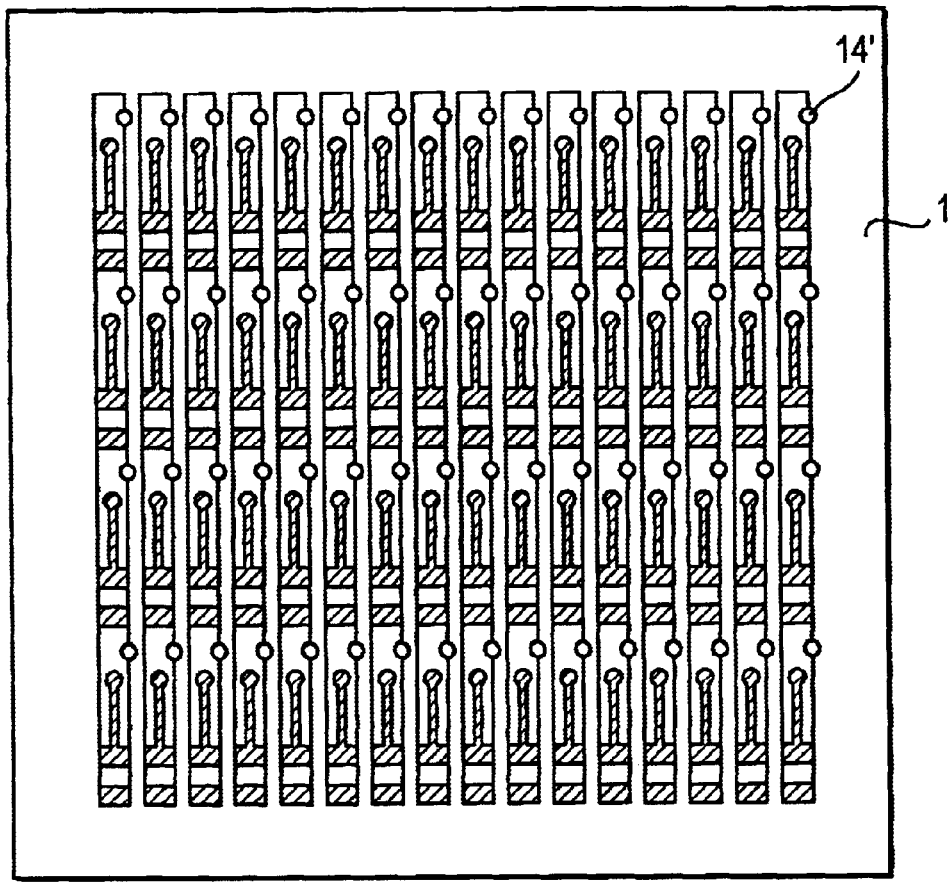
FIGS. 5A and 5B show a state in a manufacturing step for substrates, each of which is used for an isolator of a second embodiment.
Figure 5B:
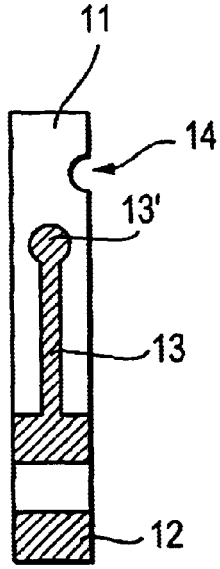

Hereinbelow, a configuration of a substrate that is used in an isolator of a second embodiment is shown in FIGS. 5A and 5B. FIG. 5A is a view showing a state of a primary substrate 1, and FIG. 5B is a view showing a configuration of one section cut out from primary substrate 1. In this example, different from that shown in FIGS. 4A and 4B, an opening 14' is provided on each of the borders of a plurality of sections of the primary substrate; and the individual sections are cut out from the primary substrate, and the portion corresponding to the opening 141 is thereby provided as a cutout portion 14.

The cutout portion 14 is provided in a position so that each shape of upper, lower, left, and right portions (the obverse and reverse faces) differs from each other. Therefore, even when the plurality of substrates 11 cut out from the primary substrate 1 once become separate parts, the upper, lower, left, and right directions of each of the substrates 11 are still detectable according to the cutout portions. Specifically, in processing up to the stage where the substrate 11 is stored in the resin housing 7 of the isolator, when a plurality of substrates 11 is once arranged in a pallet, the shapes of openings provided in the pallet are arranged to engage with the substrates 11. Also, a vibratory feeding machine is used to align the individual substrates 11 in the same upper, lower, left, and right directions and to feed them to the pallet. Even if a substrate 11 enters the opening in the pallet in the upper, lower, left, and right directions differing from proper directions, since the substrate 11 is immediately forced out of the opening by vibration of the vibratory feeding machine, only substrates 11 engaged with the individual openings in the proper upper, lower, left, and right directions remains to be engaged with the openings and are thereby held. Thereafter, the substrates 11 are individually adsorbed by an automatic mounting machine, and they are stored in the individual resin housings 7 of the isolators. This allows the substrates 11 to be stored in the resin housings 7 in a predetermined direction.

Figure 6:
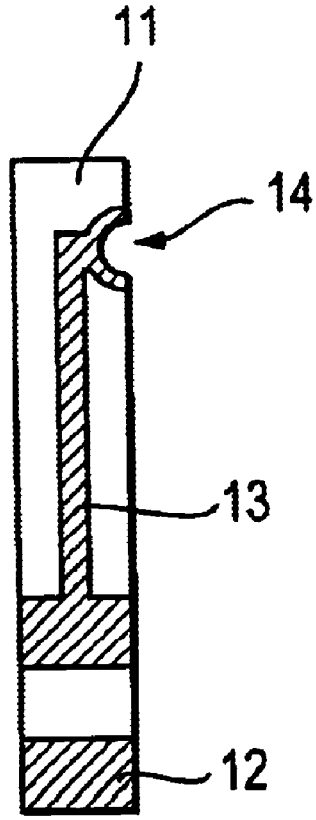
FIG. 6 is a plan view of a substrate used for an isolator of a third embodiment.

FIGS. 6A and 6B show a construction of a substrate 11 that is used in an isolator of a third embodiment. Differences from that shown in FIG. 5B are that a conductor pattern 13 is formed to extend up to a cutout portion 14, and in addition, is electrically connected to a conductor pattern on the reverse face of the substrate 11 via an end face of the cutout portion 14. In this configuration, the cutout portion 14 can be concurrently used as a through-hole, and manufacturing steps and costs can be thereby reduced.

Figure 7A:
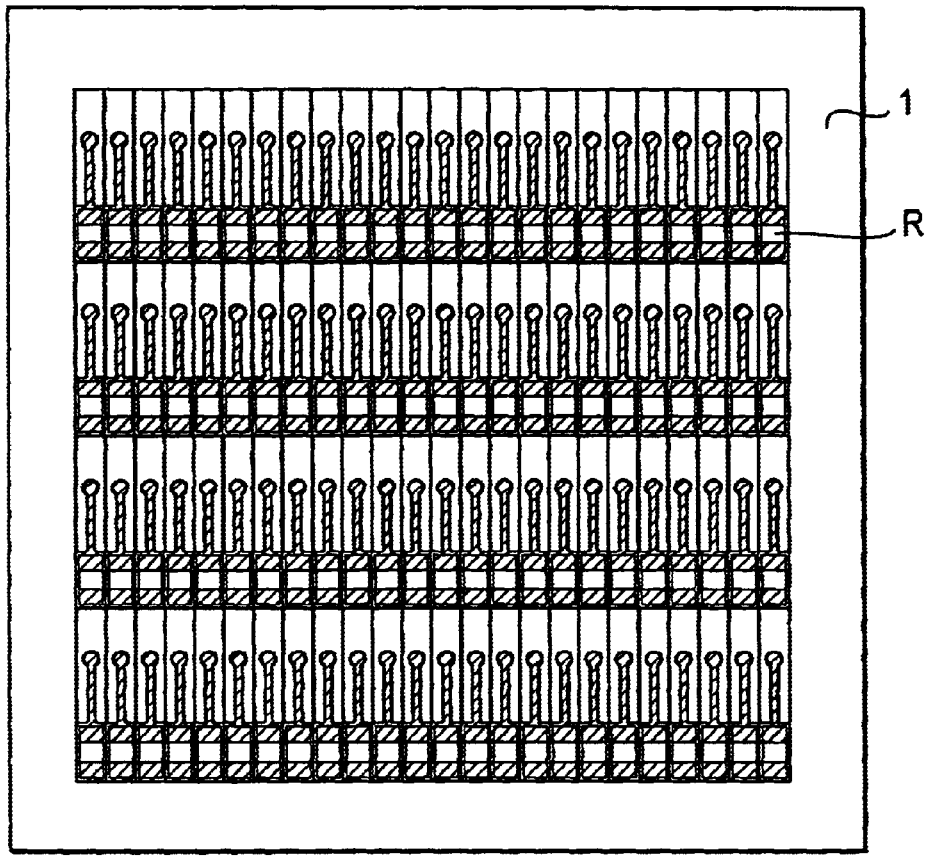
FIGS. 7A and 7B show a state in a manufacturing step for substrates, each of which is used for an isolator of a fourth embodiment.
Figure 7B:
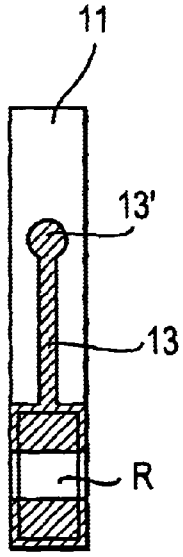

FIGS. 7A and 7B show a construction of a substrate 11 that is used in an isolator of a fourth embodiment. In the figure, FIG. 7A is a plan view of a state of a primary substrate 1, and FIG. 7B is a plan view of a substrate cut out from the primary substrate. As shown in FIG. 7A, a termination resistor R is first mounted in each section of the primary substrate 1; and thereafter, the section is cut out so as to obtain a substrate 11 with the termination resistor R being mounted, as shown in FIG. 7B.

To mount termination resistor R on the primary substrate, first of all, solder paste is printed and applied on the primary substrate 1, a machine (mounter) is then used, and the resistor is thereby mounted. Thereafter, it is passed through a reflow furnace to solder a plurality of the termination resistors R at one time on the primary substrate 1.

In the state of the primary substrate 1, since per-section relative positional accuracy is extremely high, the resistor R, a very small chip-type component, can be mounted at high relative-positional accuracy at a predetermined position in each of the sections. Thereafter, the primary substrate 1 is cut out by using a tool such as a dicer, and the substrate 11 is thereby obtained. According to the above method, the productivity can be improved, and costs can also be reduced.

To connect the resistor R on the conductor pattern on the substrate 11, instead of the conductive connecting material, such as the solder, a conductive adhesive may be used. In addition, in the state of the primary substrate 11, the electrical conductivity is not established between electrodes on the substrate 1 and electrodes of the resistor R, the bottom face of the resistor R is fixed with an insulating adhesive on a portion of the substrate 11 in which no electrode is formed, and the isolator is built in a resin housing 7, and thereafter, the electrodes of the resistor R are soldered to the conductor patterns.

Also, the individual sections are cut out from the primary substrate 1, the individual, separate substrates 11 are provided, and resistors and other high-frequency components may be mounted thereon in units of the substrate 11. This method can be applied to a manufacturing system for individually mounting high-frequency components on the substrates 11.

Figure 8A:
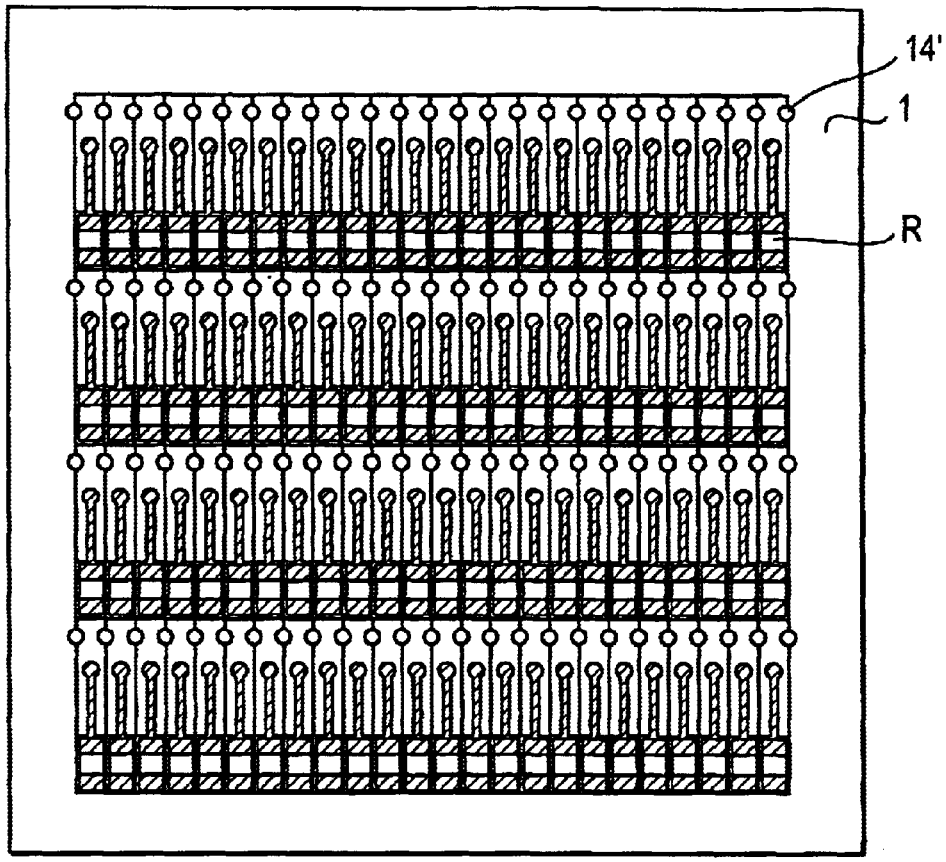
FIGS. 8A and 8B show a state in a manufacturing step for substrates, each of which is used for an isolator of a fifth embodiment.
Figure 8B:
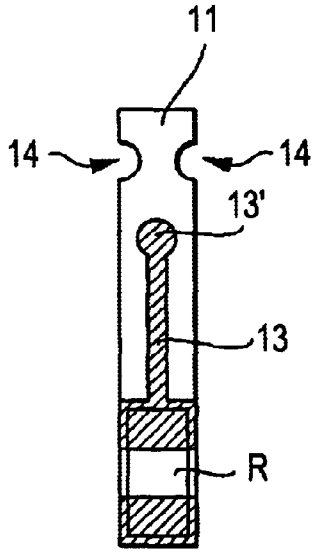

FIGS. 8A and 8B show a construction of a substrate 11 that is used in an isolator of a fifth embodiment. In this example, an opening 14' is formed on each of the borders of adjacent sections in a primary substrate 1, a resistor R is mounted on each of the sections in the state of a primary substrate 1, thereafter, the individual sections are cut out from the primary substrate, and as shown in FIG. 8B, the substrate 11 having a cutout portion 14 is obtained. In this example, even when the left and right directions (the obverse and reverse faces) of the substrate 11 are reversed, although the contour of the substrate 11 is the same, since the resistor R is already mounted on the surface of the substrate 11 when the substrate 11 is cut out from the primary substrate 1, no cases occur that it enters the opening of the above-described pallet with the resistor R facing down. Specifically, even when it is put into the opening, it does not properly engage with the opening because a protrusion of the resistor R, it is immediately forced out of the pallet by vibratory feeding, and only the substrates 11 in the state of having the resistor R on the upper face remain to be held in the openings of the pallet.

Figure 9A:
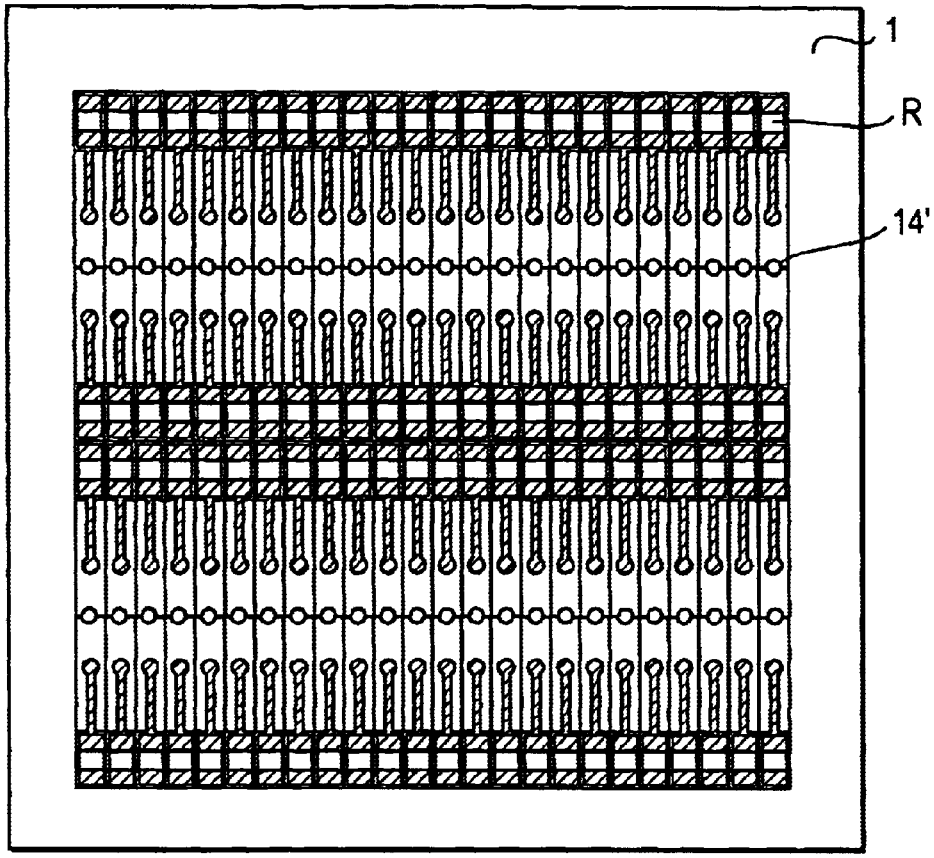
FIGS. 9A and 9B show a state in a manufacturing step for substrates, each of which is used for an isolator of a sixth embodiment.
Figure 9B:
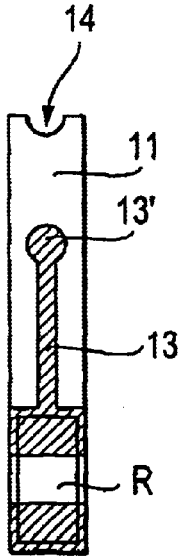

FIGS. 9A and 9B show a construction of a substrate 11 that is used in an isolator of a sixth embodiment. In this example, an opening 14' is formed on each of the borders of short sides of individual sections in a primary substrate 1; and the individual sections are cut out after resistors R are individually mounted on individual sections. Thereby, as shown in FIG. 9B, a substrate 11 having a cutout portion 14 on its short side is obtained. Also, in this case, depending on whether or not the resistor R exists on the surface of the substrate 11, the obverse and reverse faces of the substrate 11 can be detected.

Figure 10A:
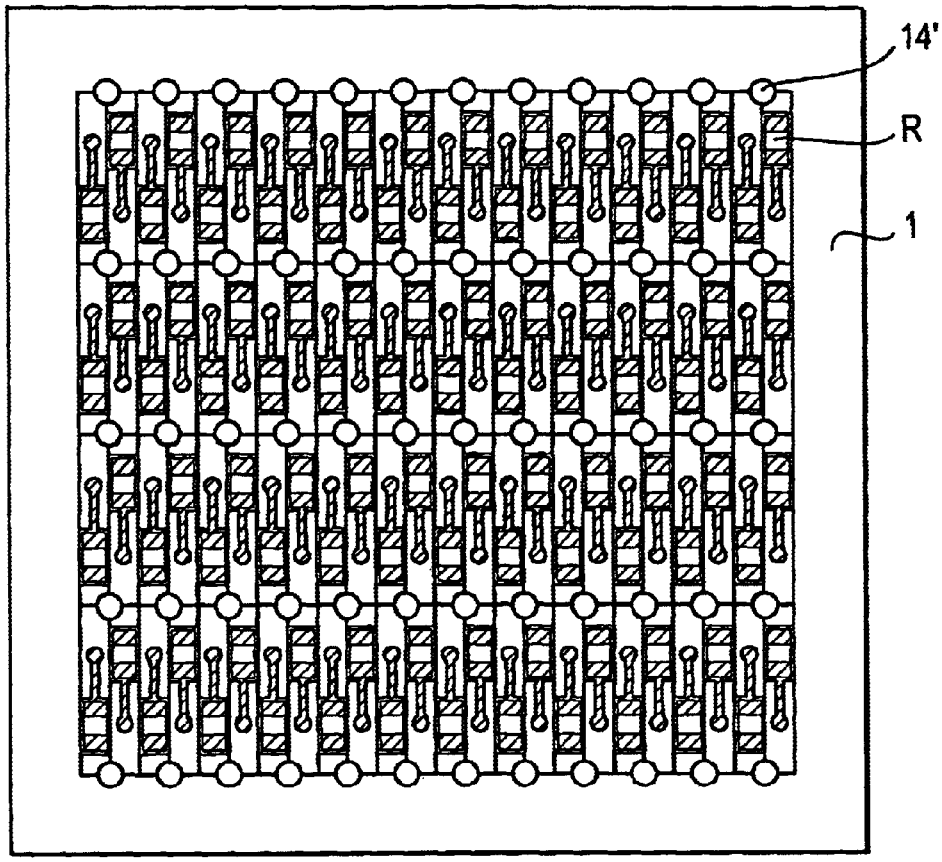
FIGS. 10A and 10B show a state in a manufacturing step for substrates, each of which is used for an isolator of a seventh embodiment.
Figure 10B:
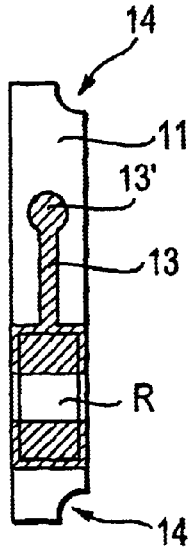

FIGS. 10A and 10B shows views of a construction of a substrate 11 that is used in an isolator of a seventh embodiment. In this example, conductor patterns in odd-number columns and even-number columns in sections of a primary substrate 1 from which individual substrates 11 are cut out are arranged in the directions opposing each other, and an opening 14' is formed in each central portion of four sections adjacent to each other. After resistors R are mounted on the primary substrate 1, the individual sections are cut out, and thereby, the substrate 11 as shown in FIG. 10B is obtained.

Hereinbelow, referring to FIGS. 11 to 13, a description will be given of an isolator according to an eighth embodiment.

Figure 11:
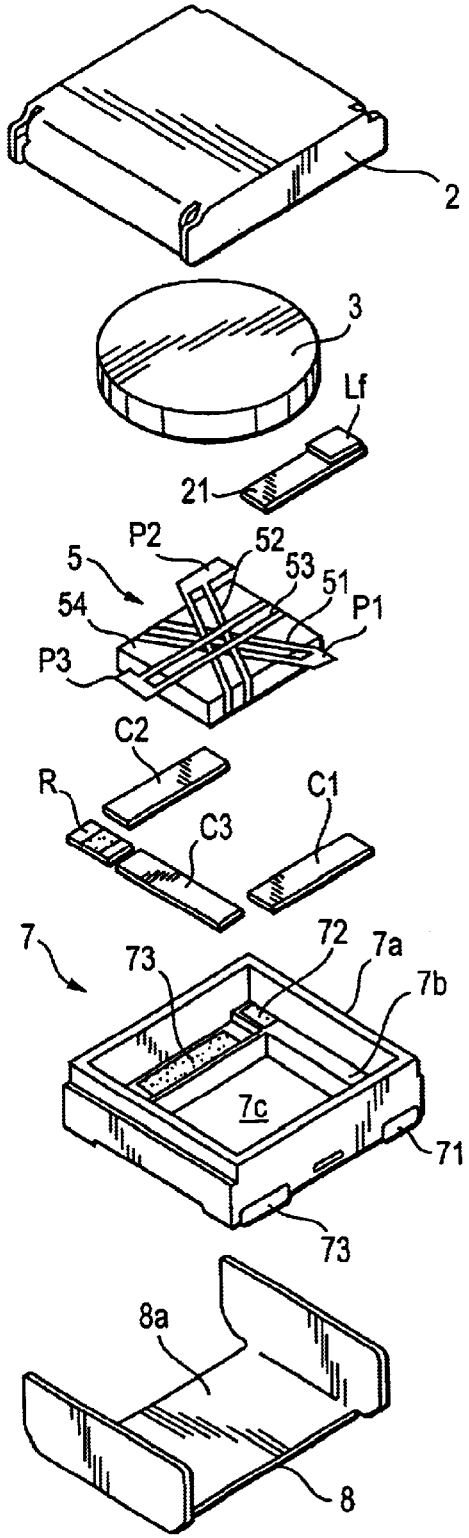
FIG. 11 is an exploded perspective view of isolator of an eighth embodiment.
Figure 12A:
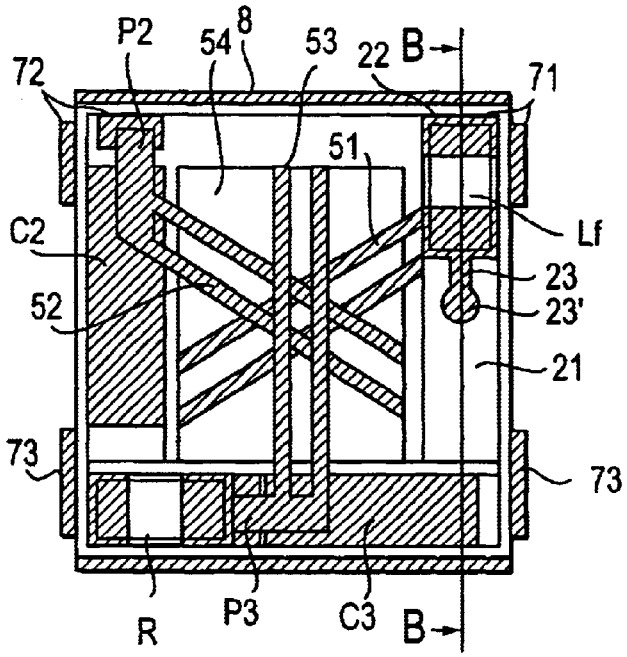
FIGS. 12A and 12B are an upper view and a cross-sectional view, respectively, of the isolator in a state where an upper yoke is removed.
Figure 12B:
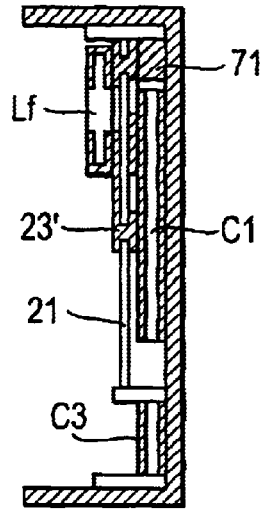

FIG. 11 is an exploded perspective view of the isolator, and FIGS. 12A and 12B are an upper view and a cross-sectional view, respectively, of a state where an upper yoke 2 is removed. As shown in FIGS. 11 to 12B, in the isolator, a disc shaped permanent magnet 3 is arranged on an inner face of a box-like upper yoke 2 formed of a magnetic metal; a closed magnetic circuit is formed of the upper yoke 2 and a substantially U-shaped lower yoke 8 formed of the same magnetic metal as above; a resin housing 7 is arranged above a bottom face 8*a* of the lower yoke 8; and a magnetic assembly 5, a substrate 21 with an inductor Lf being mounted, matching capacitors C1, C2, and C3, and a resistor R are arranged in the resin housing 7.

Figure 21:
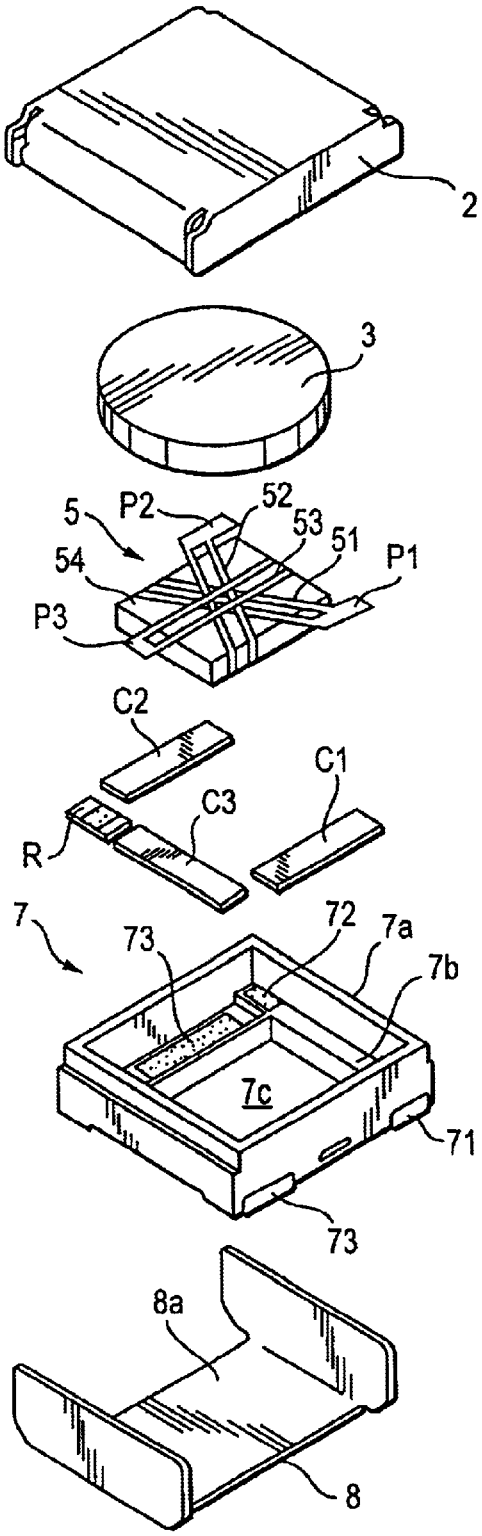
FIG. 21 PRIOR ART
FIG. 21 is an exploded perspective view of a conventional isolator.
Figure 22A:
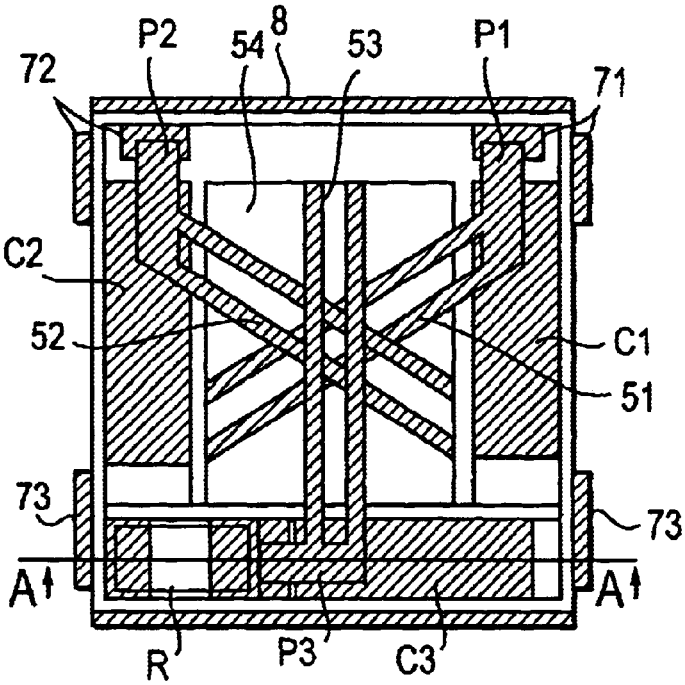
FIG. 22A PRIOR ART
FIGS. 22A and 22B are an upper view and a cross-sectional view, respectively, of the isolator.
Figure 22B:
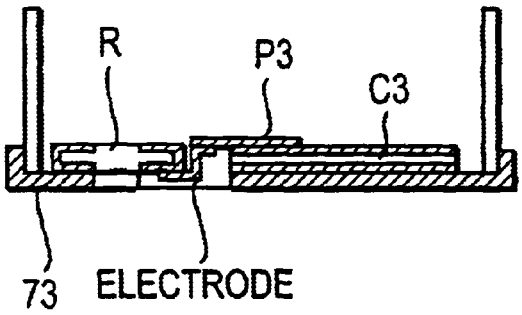
FIG. 22B PRIOR ART
Figure 23A:
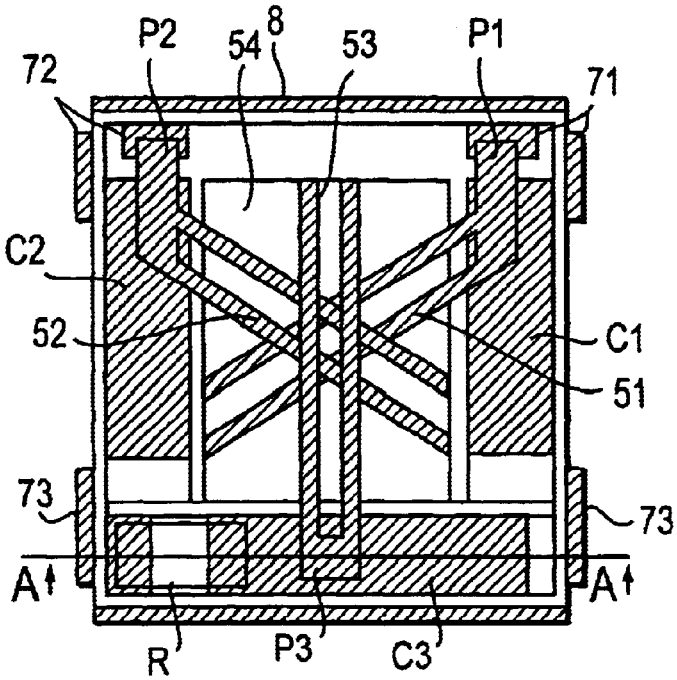
FIG. 23A PRIOR ART
FIGS. 23A and 23B are an upper view and a cross-sectional view of another conventional isolator in a state where an upper yoke is removed.
Figure 23B:
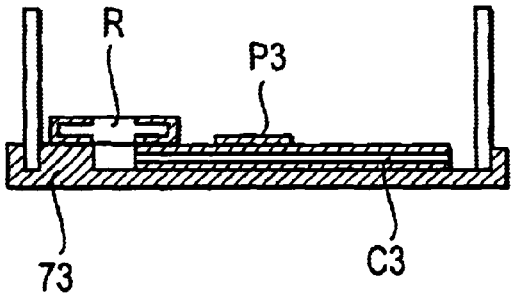
FIG. 23B PRIOR ART

In the present embodiment, an inductor Lf is provided as a high-frequency component for a filter; and it differs from the isolator shown in FIG. 1 such that the resistor R is arranged in the resin housing 7 as in the construction shown in FIG. 21, the inductor Lf is mounted on the substrate 21, and in this state, it is installed in the resin housing 7. A port P1 of a central conductor 51 is formed short so as not to contact an input/output terminal 71.

On the substrate 21, conductor patterns 22 and 23 are formed, to which two electrodes of the inductor Lf are electrically connected. A through-hole 23' electrically connected to a conductor pattern on the reverse face of the substrate 21 is formed at an end portion of a conductor pattern 23. Also, a through-hole electrically connected to a conductor pattern on the reverse face of the substrate 21 is formed in a conductor pattern 22. Via the conductor pattern of the substrate 21 and the through-holes, the individual electrodes of the inductor Lf are electrically connected to the input/output terminal 71 and an electrode on an upper face of the capacitor C1.

Figure 13:
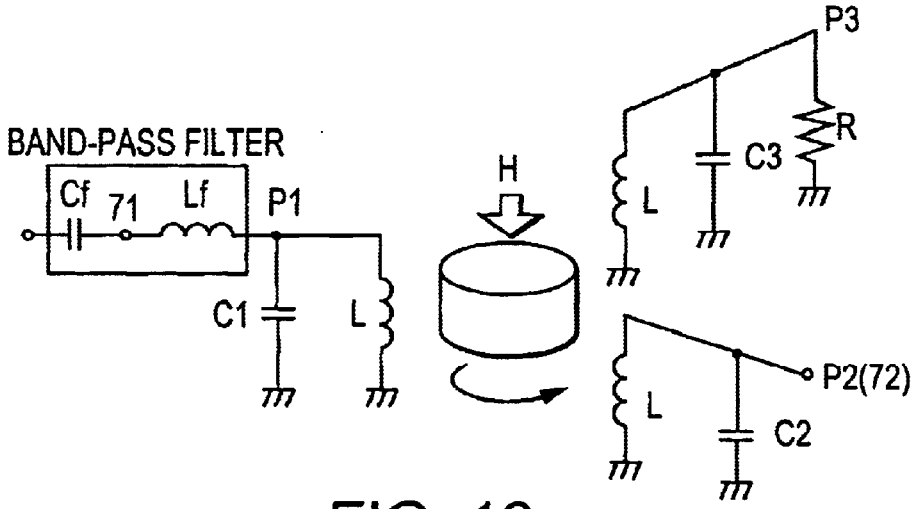
FIG. 13 is an equivalent circuit diagram of the isolator.

FIG. 13 is an equivalent circuit diagram of the above-described isolator. The figure shows a portion up to where a capacitor Cf is serially connected to the input/output terminal 71. The capacitor Cf and the above-described inductor Lf together form a bandpass filter. In the figure, the ferrite member is shown in a disc shaped shape, a direct-current electric field is represented by H, and the above-described central conductors 51, 52, and 53 are represented by equivalent inductors L. According to this configuration, when a signal input from the input/output terminal 71, frequency components thereof, such as a two-fold wave and three-fold wave with respect to the dominant wave, which cause unnecessary radiation, are attenuated, and the signal is then output from the input/output terminal 72. Also, a signal input from the input/output terminal 72 is resisted and terminated by the resistor R connected to between a ground and the port P3 of the central conductor 53, and the signal almost does not return to the side of the input/output terminal 71. As described above, the isolator is constructed that has a filter function for attenuating the unnecessary frequency components.

Hereinbelow, referring to FIGS. 14 to 16, a description will be given of an isolator according to a ninth embodiment.

Figure 14:
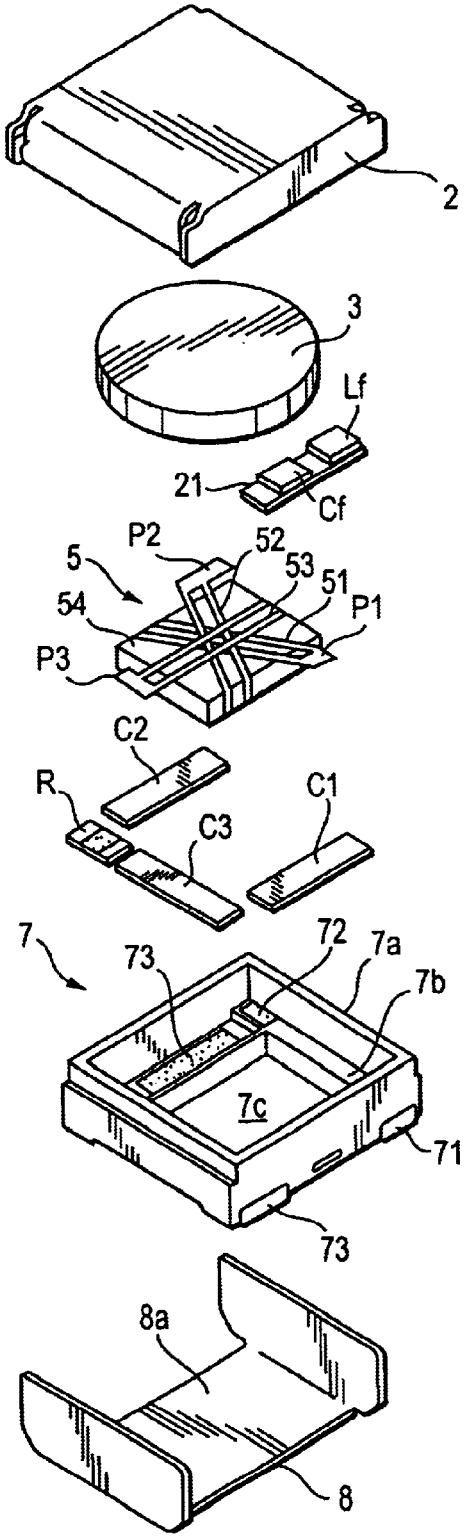
FIG. 14 is an exploded perspective view of an isolator of a ninth embodiment.
Figure 15A:
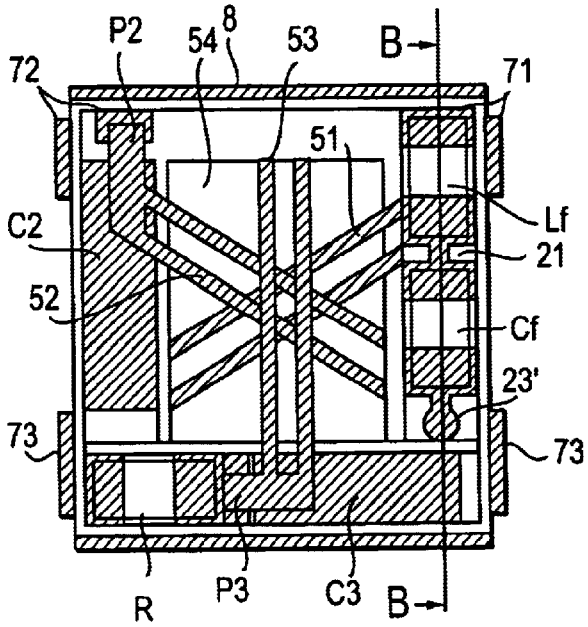
FIGS. 15A and 15B are an upper view and a cross-sectional view, respectively, of the isolator in a state where an upper yoke is removed.
Figure 15B:
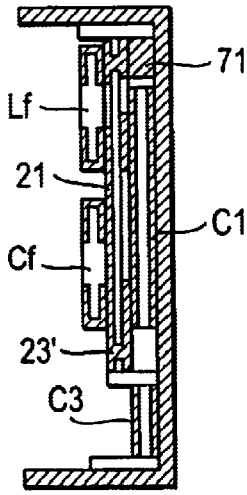
Figure 16:
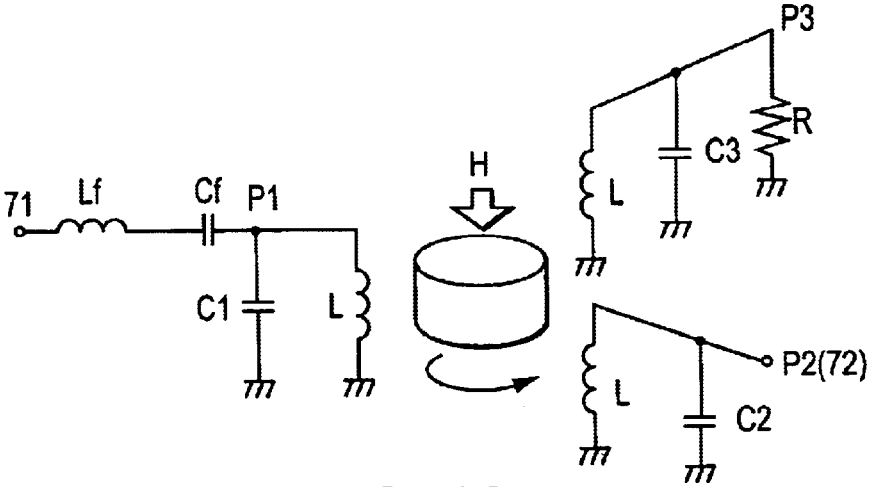
FIG. 16 is an equivalent circuit diagram of the isolator.

FIG. 14 is an exploded perspective view of the isolator, FIGS. 14A and 14B are an upper view and a cross-sectional view, respectively, of a state where an upper yoke 2 is removed, and, FIG. 16 is an equivalent circuit diagram. In this embodiment, both inductor Lf and capacitor Cf that together form a bandpass filter are provided in a resin housing 7. Specifically, the inductor Lf and the capacitor Cf are mounted on a substrate 21, and a series circuit formed of the inductor Lf and the capacitor Cf is connected between a port P1 and an input/output terminal 71. Other configurations are similar to those of the first and eight embodiments.

According to the above-described construction, without a circuit being added in the outside, the isolator having bandpass-filter characteristics is configured. Thus, according to the arrangement of the inductor Lf and the capacitor Cf, which are used for the bandpass filter, on matching capacitors C1 and C2, a specific spacing need not be secured for arrangement of components and a substrate for the bandpass filter, thereby allowing further miniaturization to be implemented overall.

Figure 17A:
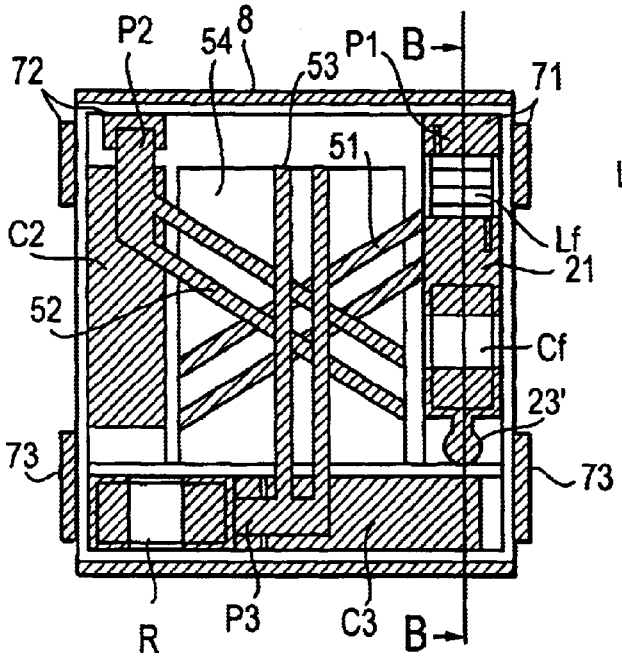
FIGS. 17A and 17B are an upper view and a cross-sectional view, respectively, of an isolator of a tenth embodiment in a state where an upper yoke is removed.
Figure 17B:
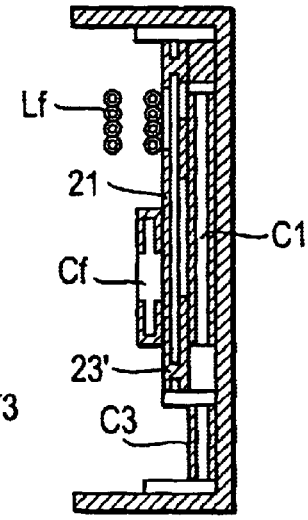

FIGS. 17A and 17B are an upper view and a cross-sectional view, respectively, of an isolator of a tenth embodiment in a state where an upper yoke is removed. Different from that shown in FIGS. 15A and 15B, in this embodiment, an air-core coil is used therein as an inductor Lf. The inductor Lf is formed such that an insulating film made of a material having high heat-resisting characteristics, such as polyimide-amide, polyester-imide, or polyimide, is coated on a copper wire; each turn of a wound wire is electrically insulated, and each of terminal sections thereof has an exposed copper-wire portion that is preliminarily plated with solder. In addition, the terminal sections of the inductor Lf are arranged such that the directions along which they extend do not overlap with a single straight line so that the inductor Lf does not roll on the substrate 21.

Figure 18A:
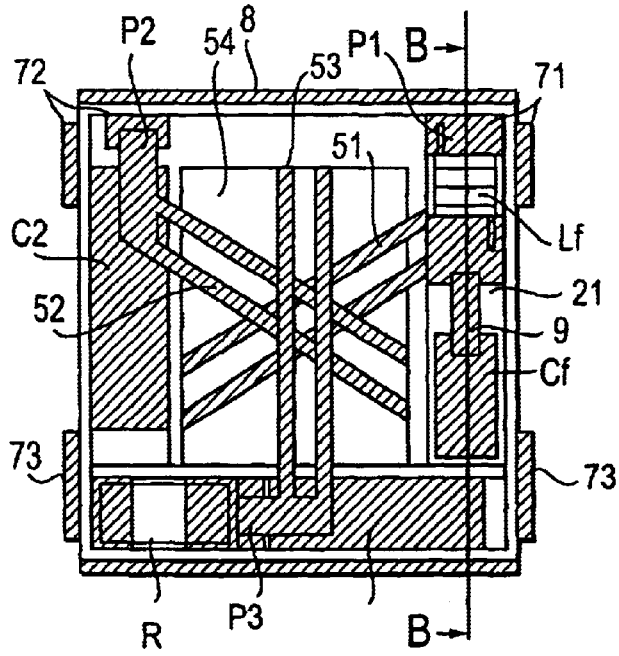
FIGS. 18A and 18B are an upper view and a cross-sectional view, respectively, of an isolator of an eleventh embodiment in a state where an upper yoke is removed.
Figure 18B:
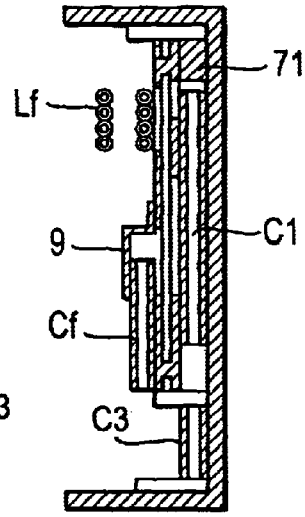

FIGS. 18A and 18B are an upper view and a cross-sectional view, respectively, of an isolator an eleventh embodiment in a state where an upper yoke is removed. Different from that shown in FIGS. 17A and 17B, in this embodiment, a chip-type capacitor having electrodes formed on obverse and reverse faces of a dielectric plate is used therein as a capacitor Cf. The reverse-face electrode of the capacitor is connected to a conductor pattern on the upper face of a substrate 21, and the obverse-face electrode thereof is connected to the electrode on the upper face of the substrate 21 via a metal plate (metal foil) 9. By using the metal plate 9 having a stepped shape, since surface-mounting of small components having electrodes on their obverse and reverse faces, further miniaturization can be implemented overall.

In each of the embodiments shown above, although the input/output-terminal side is arranged to be the inductor Lf, the sequence of the inductor Lf and the capacitor Cf may be reversed. In addition, only the capacitor Cf may be stored in the resin housing 7, and the inductor Lf may be externally provided.

Figure 19:
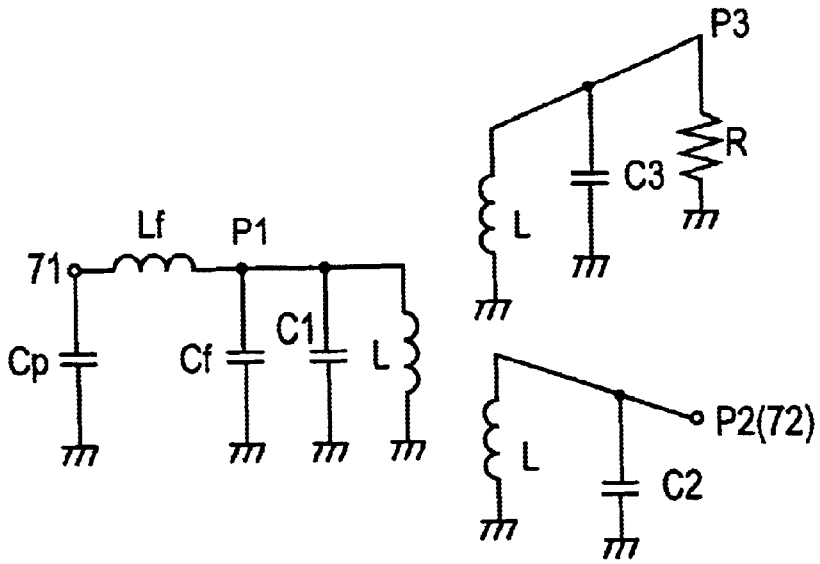
FIG. 19 is an equivalent circuit diagram of an isolator of a twelfth embodiment.

Although the bandpass filter is used as an example filter provided in the isolator in some of the above-described embodiments, the configuration may be such that the above-described inductor Lf is used to configure a low pass filter, and an isolator having low pass filter characteristics may thereby be configured. FIG. 19 shows an equivalent circuit of the housing. However, a ferrite member is not shown therein. In this, Lf denotes an inductor similar to that provided in each of the above-described embodiments. Also, Cf denotes a part of the capacitor C1, but it is shown separately from the capacitor C1 in the equivalent circuit for convenience. Therefore, the capacitance value of the matching capacitor C1 to which a port section P1 of the first central conductor is connected is actually set to the value in which the capacitance Cf for filter is added to the electrostatic capacitance originally necessary for matching. Cp denotes the distributed capacitance generated between an electrode on the mounting substrate to which the input/output terminal 71 is connected and a ground. According to a $\pi$-type circuit formed of the inductor Lf, the capacitance Cp, and the capacitor Cf, a low pass filter is configured. In the above, the capacitance Cp may be provided using a chip-type component.

By cutting out the above-shown high-frequency components, such as the inductor Lf and the capacitor Cf after they are mounted in the individual sections in the state of the primary substrate 1, and they are stored in the resin housing 7, the isolator containing the additional circuit can be easily manufactured.

Figure 20:
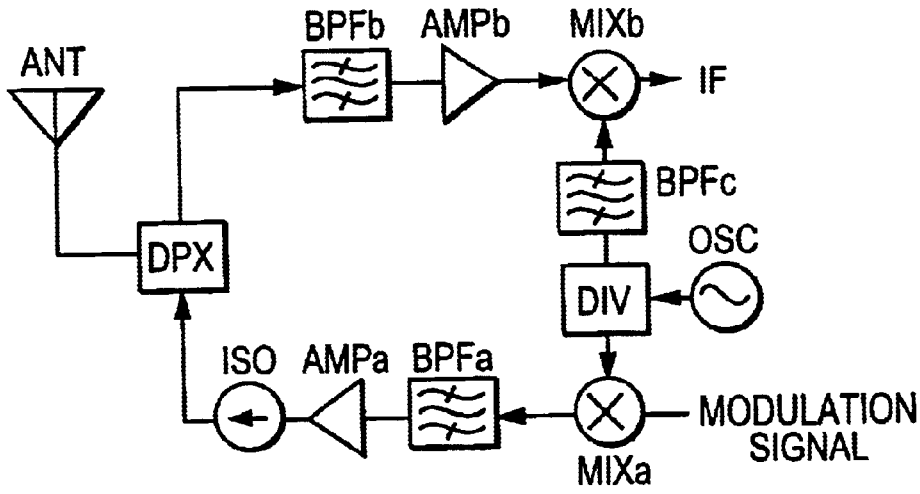
FIG. 20 is a block diagram showing a configuration of a communication apparatus.

Hereinbelow, referring to FIG. 20, an example communication apparatus using one of the described isolators will be described. In the figure, ANT denotes a transmission/reception antenna; DPX denotes a duplexer; each of BPFa, BPFb, and BPFc denotes a bandpass filter; each of AMPa and AMPb denotes an amplifier circuit; each of MIXa and MIXb denotes a mixer; OSC denotes an oscillator; ISO denotes an isolator; and DIV denotes a power divider. The mixer MIXa uses modulation signals to modulate frequency signals output from the power divider DIV; the bandpass filter BPFa passes the signals only in a transmission frequency signal band; the amplifier circuit AMPa performs power-amplification of the signals, and transmits the signals from the antenna ANT via the isolator ISO and the duplexer DPX. The bandpass filter BPFb passes only a reception-signal band out of those outputted from the duplexer DPX, and the amplifier circuit AMPb amplifies them. The mixer MIXb mixes frequency signals output from the bandpass filter BPFc and reception signals and thereby outputs intermediate frequency signals IF.

For the isolator ISO, the isolator shown in one of the above-described embodiments is used. In a configuration in which the isolator ISO has one of a bandpass filter and a low pass filter, the bandpass filter BPa passing only the transmission frequency band may be omitted. Thus, a communication apparatus that is small as overall is configured.

In the described embodiments, while description has been made using the isolators as examples, the present invention may be applied to a circulator configured such that the termination resistor R is not connected to the port P3 of the third central conductor in each of the embodiments, but the port P3 is used as a third input/output section.

What is claimed is:

1. A nonreciprocal circuit device comprising:

a housing;

a magnetic body which receives a direct-current magnetic field;

a plurality of central conductors intersecting with each other provided on said magnetic body;

a substrate; and a high-frequency chip component mounted on a surface of said substrate;

wherein said magnetic body, said plurality of central conductors, and said substrate are stored in said housing;

at least one port of said central conductors is electrically connected to one of an electrode of said high-frequency component and an electrode of said substrate which is electrically connected to said electrode of said high-frequency; and the substrate is disposed on the at least one port.

2. A nonreciprocal circuit device as stated in claim 1, wherein a cutout portion is formed at one of a side and a corner of said substrate.

3. A nonreciprocal circuit device as stated in claim 1, wherein electrodes on obverse and reverse faces of said substrate are electrically connected together via an end face of said cutout portion.

4. A nonreciprocal circuit device as stated in one of claims 1 to 3, wherein said high-frequency chip component includes electrodes provided on planar obverse and reverse faces thereof, the electrode on the reverse face of said high-frequency chip component is electrically connected to the electrode on said substrate, and the electrode on the obverse face of said high-frequency chip component and the electrode on said substrate are connected together via a step-shaped metal plate.

5. A nonreciprocal circuit device as stated in one of claims 1 to 3, wherein said high-frequency chip component is one of a resistor, an inductor, and a capacitor.

6. A communication apparatus including the nonreciprocal circuit device as stated in one of claims 1 to 3.

7. A manufacturing method of said nonreciprocal circuit device as stated in one of claims 1 to 3, comprising steps of:

mounting high-frequency chip components in units of a plurality of sections of a primary substrate;

cutting out substrates from said primary substrate in the units of said plurality of sections; and storing, in said housing, a respective one of said substrates on which said high-frequency chip components are mounted, said magnetic body which receives the direct-current magnetic field, and said plurality of central conductors intersecting with each other provided on said magnetic body.

8. A manufacturing method of said nonreciprocal circuit device as stated in one of claims 1 to 3, comprising steps of:

cutting out individual substrates from a primary substrate in the units of a plurality of sections;

mounting high-frequency chip components on the individual substrates; and storing, in said housing, a respective one of said substrates on which said high-frequency chip components are mounted, said magnetic body which receives the direct-current magnetic field, and said plurality of central conductors intersecting with each other provided on said magnetic body.

9. A manufacturing method for said nonreciprocal circuit device as stated in claim 1, comprising steps of:

providing openings at a border of a plurality of sections of a primary substrate, forming cutout portions by cutting out substrates from said primary substrate in the units of said plurality of sections.

10. A manufacturing method for said nonreciprocal circuit device as stated in claim 1, comprising steps of:

detecting obverse and reverse faces and the direction of said substrate having cutout portions according to the position of said cutout portions, storing said substrate in said housing such that a predetermined face of said substrate is arranged in a predetermined direction.

11. A nonreciprocal circuit device as stated in claim 1, wherein a conductor pattern is provided on said substrate, and the high-frequency chip component is soldered on said conductor pattern.

12. A nonreciprocal circuit device as stated in claim 1, wherein two conductor patterns are provided on said substrate, and said high-frequency chip component is soldered between said two conductor patterns.

13. A nonreciprocal circuit device as stated in claim 1, wherein said substrate is an elongated rectangular substrate provided along only one edge of said magnetic body.

* * * * *